US007293628B2

(12) United States Patent
Takahashi

(10) Patent No.: US 7,293,628 B2
(45) Date of Patent: Nov. 13, 2007

(54) SHELL MAIN BODY FOR MUFFLER

(75) Inventor: Koichi Takahashi, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 203 days.

(21) Appl. No.: 11/130,148

(22) Filed: May 17, 2005

(65) Prior Publication Data

US 2005/0252713 A1 Nov. 17, 2005

(30) Foreign Application Priority Data

May 17, 2004 (JP) ..... 2004-146841

(51) Int. Cl.
*F01N 7/18* (2006.01)

(52) U.S. Cl. ..... 181/227; 181/247; 181/249; 181/250; 181/255; 181/266; 181/269; 181/272; 181/273; 181/276; 181/282

(58) Field of Classification Search ..... 181/227, 181/247, 249, 250, 255, 266, 269, 272, 273, 181/276, 282

See application file for complete search history.

(56) References Cited

U.S. PATENT DOCUMENTS

| | | | | | |
|---|---|---|---|---|---|
| 2,652,128 | A | * | 9/1953 | Cary | 181/266 |
| 2,958,389 | A | * | 11/1960 | Deremer | 181/266 |
| 3,209,787 | A | * | 10/1965 | Brown et al. | 138/114 |
| 3,557,904 | A | * | 1/1971 | Grote | 181/266 |
| 3,945,460 | A | * | 3/1976 | McMillan | 181/282 |
| 4,109,755 | A | * | 8/1978 | Grueneberg | 181/256 |
| 4,422,525 | A | * | 12/1983 | Seeger | 181/255 |
| 4,993,512 | A | * | 2/1991 | Lescher | 181/227 |
| 5,164,551 | A | | 11/1992 | Harwood et al. | |
| 5,302,783 | A | * | 4/1994 | Sadr et al. | 181/243 |
| 5,365,025 | A | * | 11/1994 | Kraai et al. | 181/249 |
| 5,682,741 | A | * | 11/1997 | Augustin et al. | 60/323 |

FOREIGN PATENT DOCUMENTS

| | | | | |
|---|---|---|---|---|
| DE | 198 13 590 | A1 | | 9/1999 |
| EP | 0 129 458 | A1 | | 12/1984 |
| EP | 0 523 008 | A1 | | 1/1993 |
| EP | 0 848 144 | A1 | | 6/1998 |
| JP | 53032225 | A | * | 3/1978 |
| JP | 55156209 | A | * | 12/1980 |
| JP | 58023213 | A | * | 2/1983 |
| JP | 2002-206422 | A | | 7/2002 |

* cited by examiner

*Primary Examiner*—Lincoln Donovan
*Assistant Examiner*—Jeremy Luks
(74) *Attorney, Agent, or Firm*—Foley & Lardner LLP

(57) ABSTRACT

A cylindrical shell main body constituting a muffler main body is formed of two layers of an inner shell and an outer shell and has a cylindrical shape with a cross section that is not a perfect circle but is defined by alternated small arc portions and large arc portions similarly to an oval, or the like. The outer shell of the shell main body has, in each of their small arc portions, four radially projecting beads continuously extending in a circumferential direction along the small arc portions and being a predetermined distance apart from one another in an axial direction, thereby allowing an upper and lower gaps between the inner shell and the outer shell in the respective large arc portions of the shell main body to communicate with each other through passages formed by the beads.

8 Claims, 7 Drawing Sheets

SHELL MAIN BODY FOR MUFFLER

BACKGROUND OF THE INVENTION

1. Field of the Invention

The present invention relates to a shell main body for a muffler in an exhaust system of a combustion engine mounted on a motor vehicle or the like.

2. Description of the Related Art

A shell main body disclosed in Japanese Patent Application Laid-open No. 2002-206422 is conventionally known as a shell main body for a muffler. As shown in a schematic cross-sectional view in FIG. 7, a shell main body 101 of this muffler main body is formed of two layers of an inner shell 102 and an outer shell 103. Each of the inner and outer shells 102 and 103 has a cylindrical shape with a cross section that is not a perfect circle but is defined by small arc portions alternating with large arc portions, similarly to an oval, a racing track-like figure, or the like.

The conventional shell main body for the muffler described above, however, has the following problem. The shell main body 101 is provided at its edge portion with openings, which are closed by end plates by press caulking or welding, respectively, causing minute gaps between them. Consequently, water enters the gaps formed between the inner shell 102 and the outer shell 103 due to capillary phenomenon, and is heated by high-temperature exhaust gas passing through the muffler main body to vaporize, resulting in pressure rise of the vapor. When this pressure rise speed exceeds a discharging speed of the vapor that is discharged from the gaps, vapor pressure in the gaps between the shells 102 and 103 sometimes rises to deform them. Incidentally, water causing such a problem sometimes splashes onto an outer periphery of the shell main body 101 and enters into the gap between the inner shell 102 and the outer shell 103.

Such a problem can be solved if a communicating path, for example a hole, is formed on an upper surface side of the shell main body 101 along its thickness direction so as to allow the gap between the inner shell 102 and the outer shell 103 to communicate with the outside of the outer shell 103, because the vapor entered into the gap can pass through the communicating path of the outer shell 103. However, in a shell main body having a cylindrical shape with a cross section that is not a perfect circle but is defined by small arc portions alternating with large arc portions, similarly to an oval, a racing track, or the like, the inner shell 102 and the outer shell 103 in the right and left small arc portions are in close contact with each other, clogging their right and left side gaps and dividing the gap into an upper and lower gaps in the large arc portions. It is undesirable to provide a lower side of the outer shell 103 with a communicating path connecting the lower gap and the outside of the outer shell 103, because a splash and/or mud is allowed to enter the lower gap through the communicating path and rust the muffler main body. Consequently, vapor entered the lower gap can escape to nowhere, resulting in pressure rise in the lower gap between the inner shell 102 and the outer shell 103. This may possibly deform the inner shell 102 and the outer shell 103.

SUMMARY OF THE INVENTION

It is an object of the present invention to provide a shell main body for a muffler capable of preventing deformation of the shell ascribable to vaporization of water entering a lower gap between an inner shell and an outer shell, in the cylindrical shell main body that constitutes a muffler main body formed by two layers of an inner shell and an outer shell and having a cylindrical cross section that is not a perfect circle but is defined by alternated small arc portions and large arc portions, similarly to an oval, a racing track, or the like.

In order to achieve the object stated above, a shell main body for a muffler according to one of the aspects of the present invention includes: an inner shell having a cylindrical shape with a cross section that is not a perfect circle but is defined by small arc portions alternating with large arc portions; and an outer shell wrapping an outer surface of the inner shell and having a cylindrical shape with a cross section that is not a perfect circle but is defined by small arc portions alternating with large arc portions, the large arc portions of the inner and outer shells forming a gap therebetween having an upper gap and a lower gap at an upper side and a lower side thereof, respectively; wherein at least one of the inner shell and the outer shell is provided with at least one radially projecting bead that extends continuously in a circumferential direction along the small arc portions of the one of the inner and outer shells to define a passage inside of the radially projecting bead so that the passage can communicate the upper gap and the lower gap with each other; and the outer shell being provided on an upper surface side thereof with a communicating path communicating the upper gap and an outside of the outer shell with each other.

In order to achieve the object stated above, a shell main body for a muffler according to another one of the aspects of the present invention includes: an inner shell having a cylindrical shape with a cross section that is not a perfect circle but is defined by small arc portions alternating with large arc portions; and an outer shell wrapping an outer surface of the inner shell and having a cylindrical shape with a cross section that is not a perfect circle but is defined by small arc portions alternating with large arc portions, the large arc portions of the inner and outer shells forming a gap therebetween having an upper gap and a lower gap at an upper side and a lower side thereof, respectively; wherein at least one of the inner shell and the outer shell is provided with at least one radially projecting bead that extends continuously in a circumferential direction along the small arc portions of the one of the inner and outer shells to space the inner shell and the outer shell from each other and define a passage formed on both sides of the radially projecting bead so that the passage can communicate the upper gap and the lower gap with each other; and the outer shell being provided on an upper surface side thereof with a communicating path communicating the upper gap and an outside of the outer shell with each other.

In the above-described shell main bodies of the present invention, the beads are provided in one of the shells to continuously extend in the circumferential direction along the small arc portions of the cylindrical cross section, thereby allowing the upper and lower gaps between the inner shell and the outer shell in the respective large arc portions of the shell main body to communicate with each other through the passages formed by the beads. Further, the communicating path through which the gap between the inner shell and the outer shell communicates with the outside of the outer shell is provided on the upper surface side of the shell main body. This structure allows vapor generated between the inner shell and the outer shell in the lower large arc portion to easily flow into the gap in the upper large arc portion through the passages and to be thereafter discharged out of the shell main body from the communicating path.

Therefore, in a cylindrical shell main body constituting a muffler main body to be formed by two layers of an inner shell and an outer shell and having a cylindrical shape with a cross section that is not a perfect circle but is defined by alternated small arc portions and large arc portions, similarly to an oval, a racing track, or the like, the above-constructed shell bodies can provide an effect of preventing the deformation of the shell ascribable to vaporization of water entering between the inner shell and the outer shell. Further, the shell with the beads can have increased stiffness, so that noise radiation can be reduced.

Preferably, the communicating path is formed by a gap that is formed between the inner shell and the outer shell and in places excluding welded portions of the inner shell and the outer shell. Therefore, the communicating path can be formed easily and at a low price, because it removes a special processing, such as a drilling process.

Preferably, the radially projecting beads are formed in plurality along each of the small arc portions, and being arranged in an axial direction of the shell main body at intervals. Therefore, the beads can prevent deformation along the axial direction of the shell main body due to increase of its axial-directional stiffness.

BRIEF DESCRIPTION OF THE DRAWINGS

The objects, features and advantages of the present invention will become apparent as the description proceeds when taken in conjunction with the accompanying drawings, in which.

DETAILED DESCRIPTION OF THE PREFERRED EMBODIMENTS

Hereinafter, embodiments of the present invention will be described with reference to the accompanying drawings.

First, a shell main body for a muffler of a first embodiment will be described with reference to the accompanying drawings of FIGS. 1 to 3.

Figure 1:
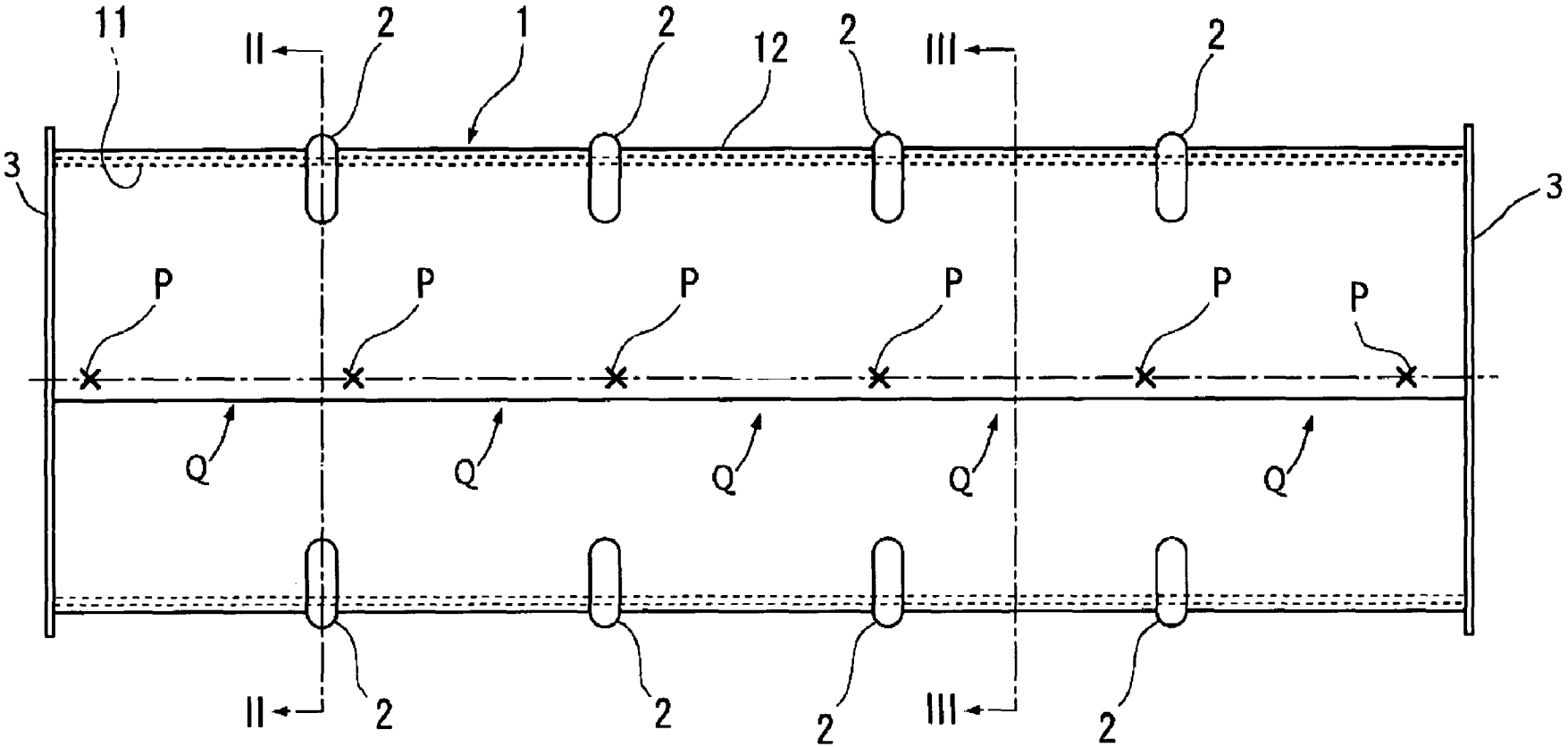
FIG. 1 is a plane view showing a shell main body for a muffler of a first embodiment according to the present invention.
Figure 2:
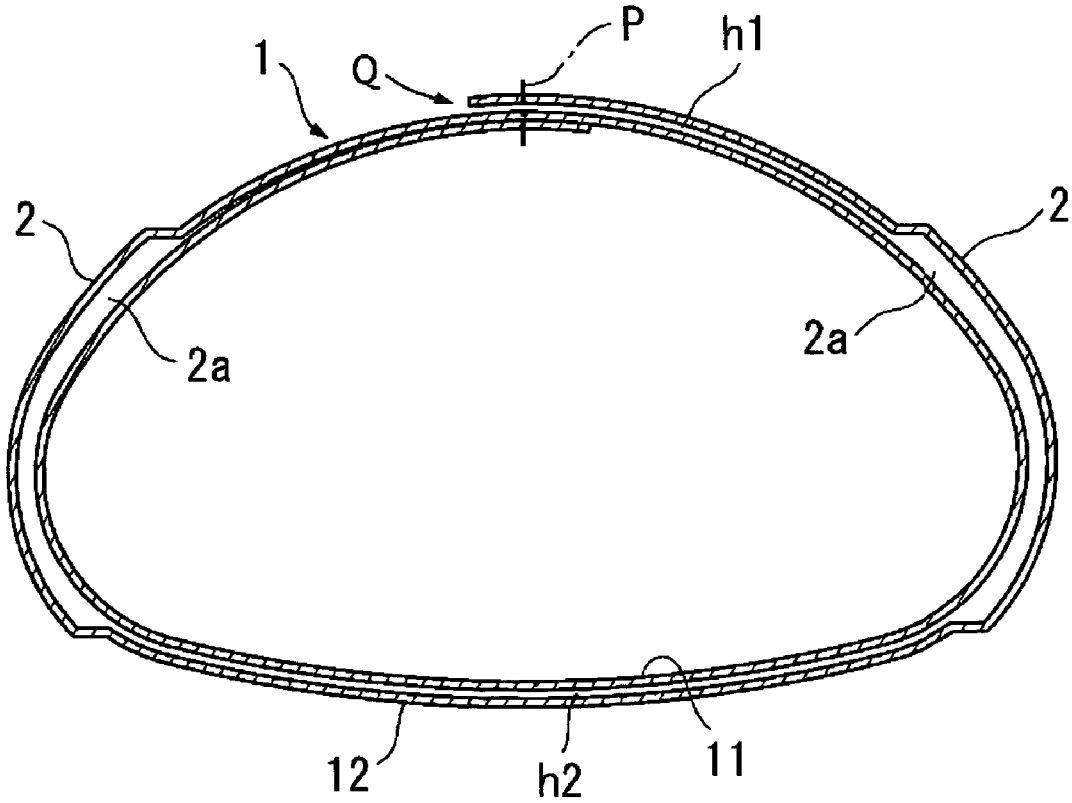
FIG. 2 is a cross-sectional view showing the shell main body taken along the II-II line in FIG. 1.
Figure 3:
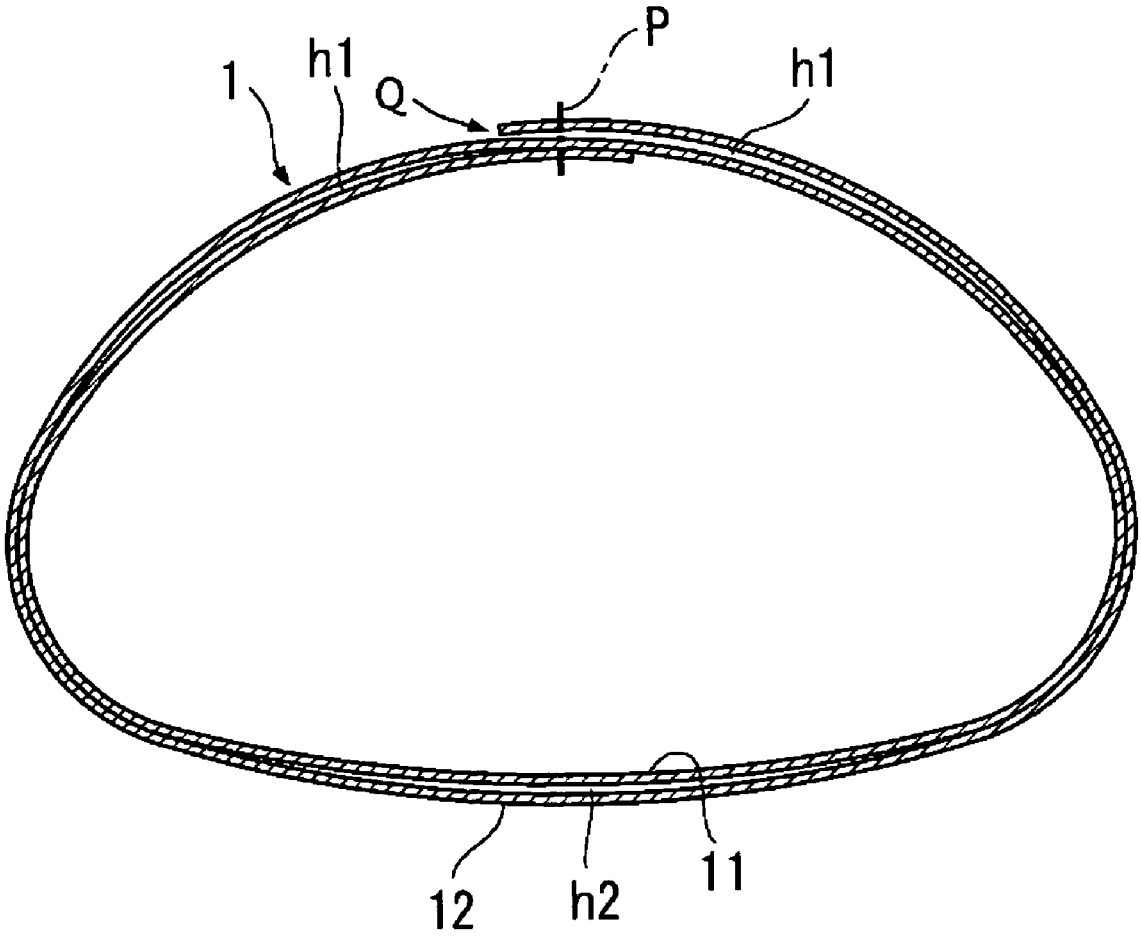
FIG. 3 is a cross-sectional view showing the shell main body taken along the III-III line in FIG. 1.

FIG. 1 is a plane view showing the shell main body of the first embodiment, FIG. 2 is a cross-sectional view showing the shell main body taken along the II-II line in FIG. 1, and FIG. 3 is a cross-sectional view showing the shell main body taken along the III-III line in FIG. 1.

The shell main body 1 of the first embodiment is used for a muffler main body of an exhaust system mounted on a motor vehicle. The muffler main body is connected at its both ends with not-shown exhaust pipes. The shell main body 1 is made of a double-rolled flat plate, with a joint portion thereof being spot-welded in portions P, and formed of two layers of an inner shell 11 and an outer shell 12 so that it has a laterally long, flattish cylindrical shape with a cross section substantially in a laterally long, rounded triangle shape.

As described above, the upper joint portions of the double-rolled flat plates formed to be the shell main body 1 are spot-welded only in the parts P being a predetermined interval apart from one another. Consequently, as shown in FIGS. 2 and 3, gaps formed in places excluding the welded portions P serve as communicating paths Q through which the outside of the outer shell 12 communicates with a upper gap h1 between the inner shell 11 and the outer shell 12 in the upper large arc portion of the shell main body 1.

To be in more detail, the outer shell 12 of the shell main body 1 is formed with four outward beads 2 continuously extending in a circumferential direction along each of the right and left small arc portions of the laterally long, flattish cylindrical shell main body, and the four beads 2 have about 5 mm in depth and about 75 mm in length to connect the upper and lower large arc portions of the shell main body 1 via its right and left small arc portions and are axially arranged at predetermined intervals from one another so that the upper gaps h1 and a lower gap h2 between the inner shell 11 and the outer shell 12 in the upper and lower large arc portions can communicate with each other through a right and left circumferential side passages 2*a* and 2*a* formed inside of the outward beads 2. The outward beads 2 act as a radially projecting bead of the present invention, and the right and left circumferential side passages 2*a* and 2*a* correspond to a passage of the present invention.

The shell main body 1 has respectively openings at its both edge portions, which are closed by end plates 3 and 3, respectively, by press caulking or welding.

Next, operations and effects of the shell main body of the first embodiment will be described.

In a case, such as at the low-temperature engine start-up time, or while a motor vehicle stops after running, moisture contained in exhaust gas is cooled off to condense into water by coming in contact with low-temperature portions of the exhaust pipe and the muffler main body, so that the water is pooled in the bottom of a hollow portion of the muffler main body.

The muffler main body is thereafter heated by the exhaust gas, so that the water vaporizes, if entering the inside of the lower gap h2 between the inner shell 11 and the outer shell 12 in the lower large arc portion of the shell main body 1 through gaps formed between the end plates 3 and 3 and the opening side edge portions of the shell main body 1. In the first embodiment, owing to the above-described structure, the vapor easily flows from the lower gap h2 into the upper gap h1, which are formed between the inner shell 11 and the outer shell 12 in the upper large arc portion, through the right and left circumferential side passages 2*a* and 2*a* formed on the inner sides of the outward beads 2. Then, the vapor in the upper gap h1 is thereafter discharged out of the shell main body 1 from the communicating paths Q formed by the gaps existing in places of the joint portion excluding the welded portions P. Accordingly, pressure rise due to water in the upper and lower gaps h1 and h2 can be suppressed.

Therefore, even when the cylindrical shell main body constitutes the muffler main body and is formed of the two layers of the inner shell 11 and the outer shell 12 to have a cross section in a laterally long, flattish cylindrical shape, this structure can provide an effect of preventing deformation of the shell main body 1 ascribable to the vaporization of water entering the upper and lower gaps h1 and h2 between the inner shell 11 and the outer shell 12.

Another effect of the first embodiment is as follows. The joint portion of the cylindrically rolled inner and outer shells 11 and 12 is welded only in the portions P by spot-welding or the like, so that the gaps existing in the places excluding the welded portions P serve as the communicating paths Q through which the upper gap h1 between the inner shell 11 and the outer shell 12 in the upper large arc portion communicates with the outside of the outer shell 12. Therefore, no special machining such as boring of the outer shell 12 is required for forming the communicating paths Q. In addition, welded portions P can be decreased, resulting in cost-reduction.

Still another effect is that the deformation of the shell main body 1 can be prevented over the entire axial length of the shell main body 1, since the plural (four each right and left sides in the first embodiment) outward beads 2 are provided in the shell main body 1 and arranged at predetermined intervals in the axial direction, thereby increasing in strength of the shell main body 1.

Yet another effect is that the discharging noise can be reduced, since the outer shell 12 having the outward beads 2 can have increased stiffness.

Next, a shell main body for a muffler of a second embodiment according to the present invention will be described with reference to the accompanying drawings of FIGS. 1 to 6. In describing the second embodiment, similar reference characters and numbers refer to similar elements in all figures of the drawings, and their descriptions are omitted for eliminating duplication.

Figure 4:
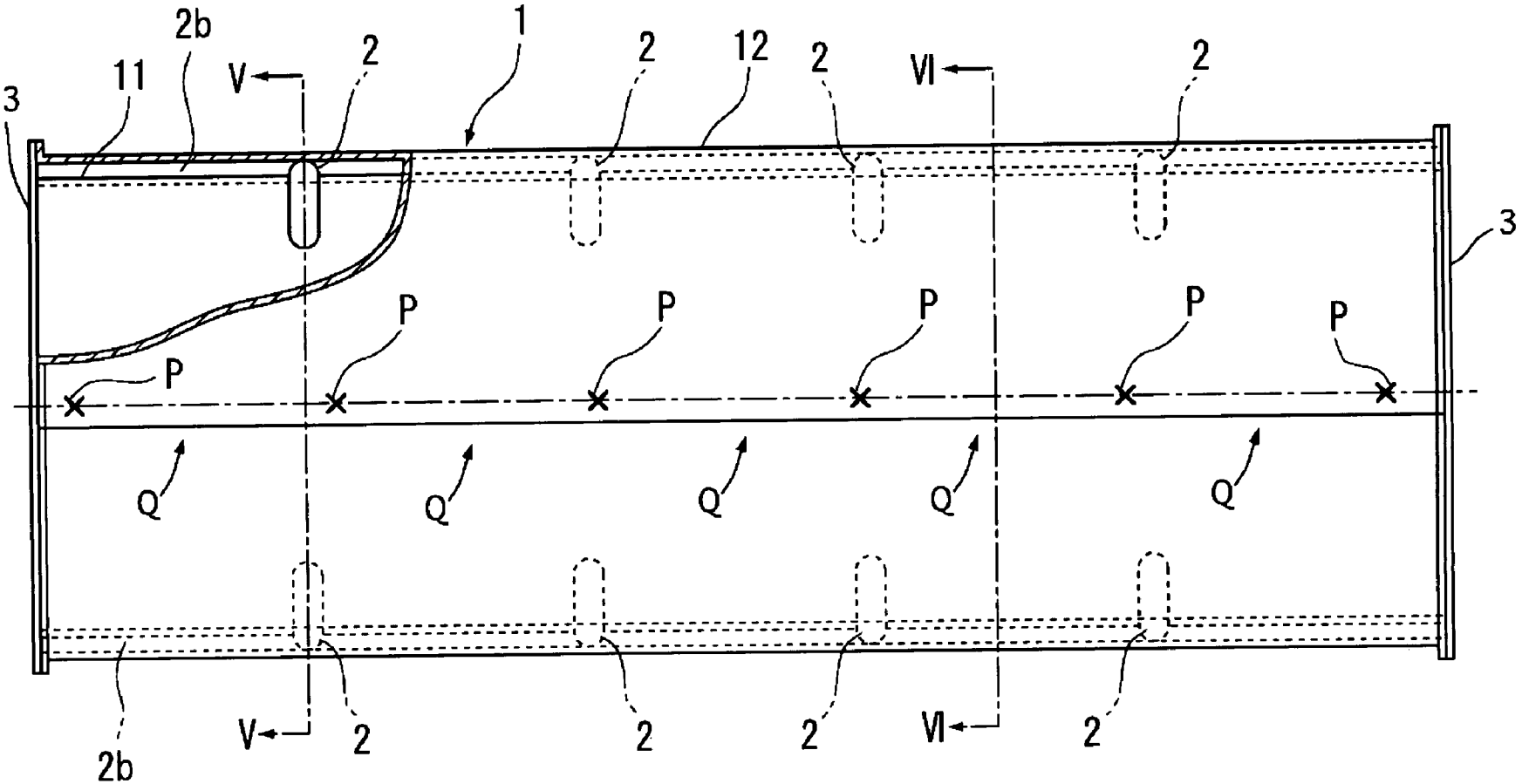
FIG. 4 is a partially sectioned plane view showing a shell main body for a muffler of a second embodiment according to the present invention.
Figure 5:
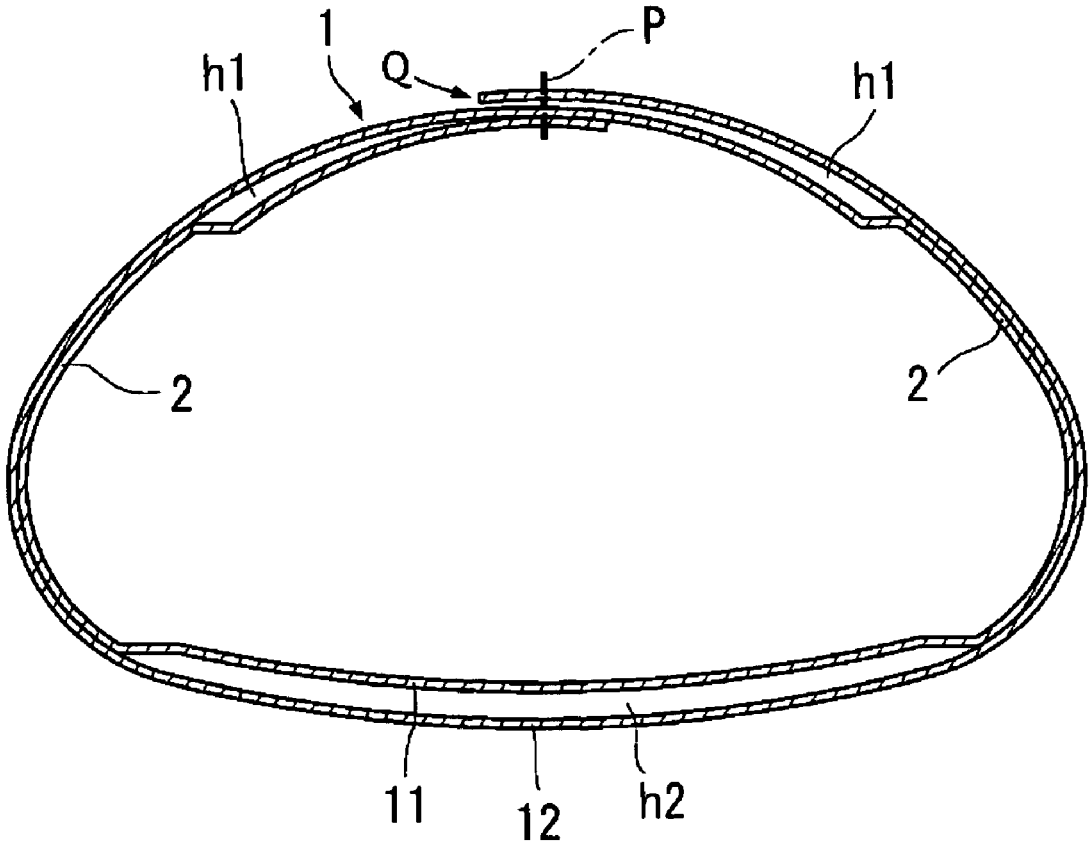
FIG. 5 is a cross-sectional view showing the shell main body taken along the V-V line in FIG. 4.
Figure 6:
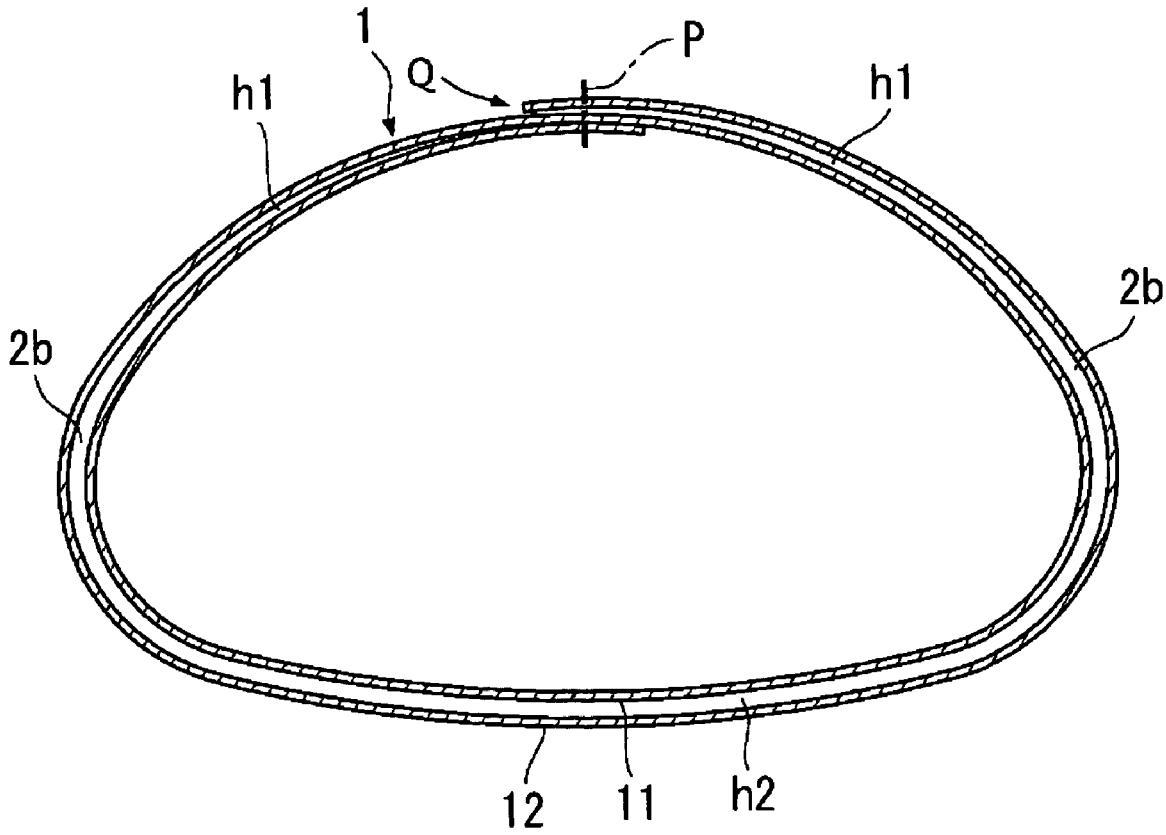
FIG. 6 is a cross-sectional view showing the shell body taken along the VI-VI line in FIG. 4.
Figure 7:
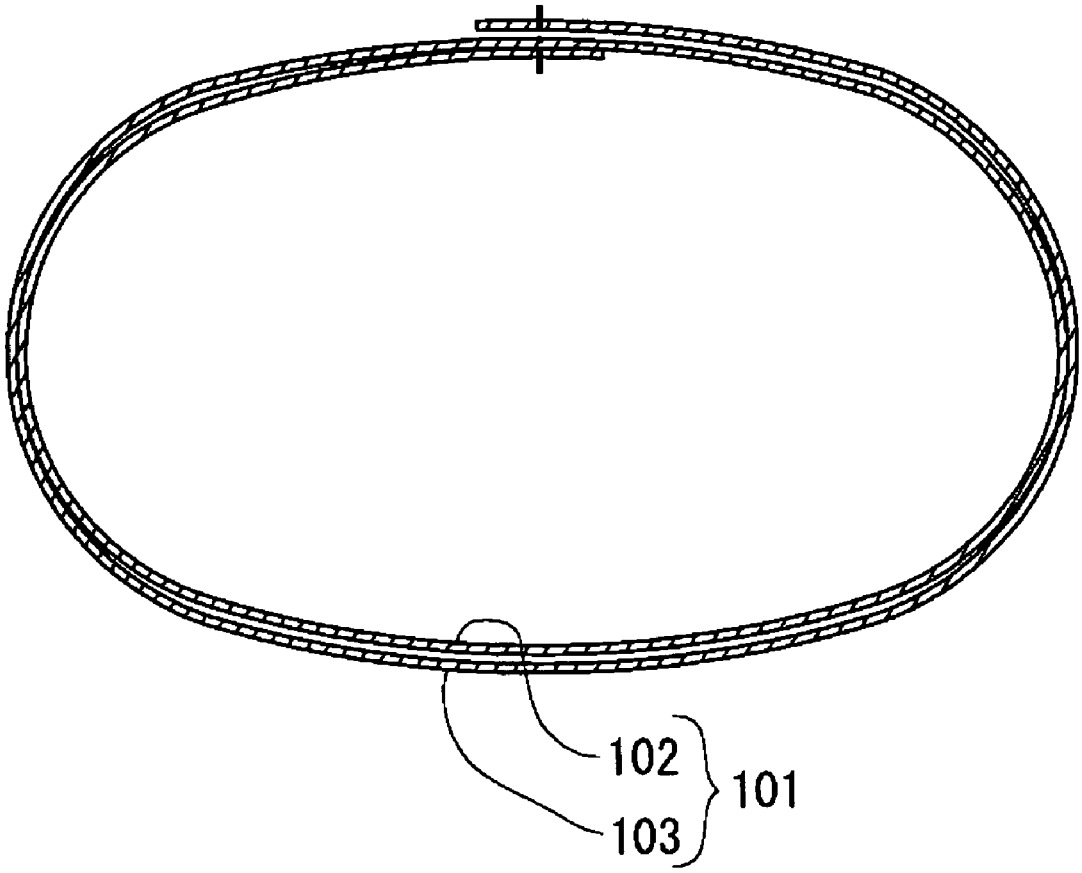
FIG. 7 PRIOR ART
FIG. 7 is a schematic cross-sectional view showing a conventional shell main body for a muffler.

FIG. 4 is a partially sectioned plane view showing a shell main body for a muffler of the second embodiment, FIG. 5 is a cross-sectional view showing the shell main body taken along the V-V line in FIG. 4, and FIG. 6 is a cross-sectional view showing the shell main body taken along the VI-VI line in FIG. 4.

This second embodiment is a modification example of the shell main body in the first embodiment described above. As shown in FIG. 5 and FIG. 6, the second embodiment is different from the first embodiment in shapes of an inner shell 11 and an outer shell 12: the outer shell 12 of the second embodiment has no outward beads, while the inner shell 11 has outward beads 2.

Specifically, the outward beads 2 of the inner shell 11 extends continuously in a circumferential direction along each of right and left small arc portions of a cylindrical shell main body 1, thereby spacing an inner surface of the outer shell 12 and an outer surface of the inner shell 11 from each other so as to form a right and left circumferential side gaps 2*b* and 2*b* on both sides of the outward beads 2, allowing an upper and lower gaps h1 and h2 between the inner shell 11 and an outer shell 12 in upper and lower large arc portions of the shell main body 1 to communicate with each other through the right and left circumferential side gaps 2*b* and 2*b*. The outward beads 2 act as a radially projecting bead of the present invention, and the right and left circumferential side gaps 2*b* and 2*b* correspond to a passage of the present invention.

Since the shell main body 1 of the second embodiment has a structure described above, it is operated in the following manner. When water enters the inside of the lower gap h2 between the inner shell 11 and the outer shell 12 in the lower large arc portion of the shell main body 1 through gaps formed between end plates 3 and 3 and opening side edge portions of the shell main body 1 and is vaporized, the vapor easily flows into the upper gap h1 between the inner shell 11 and the outer shell 12 in the upper large arc portion through the right and left circumferential side gaps 2*b* and 2*b* formed on both sides of the outward beads 2 and is thereafter discharged out of the shell main body 1 from communicating paths Q formed by gaps existing in places excluding welded portions P.

Therefore, the shell main body of the second embodiment can provide the same effects as those of the first embodiment.

The embodiments have been described hitherto, but the present invention is not limited to the embodiments described above. Any design change and so forth without departing from the spirit of the present invention is to be embraced in the present invention.

For example, the four outward beads 2 are provided along each of the small arc portions in the embodiments, but the number thereof may be any.

Although the embodiments have described the examples where the shell main body 1 has a cross section in a substantially rounded triangle shape, the shell main body 1 may have a cross section in any other shape, as long as it is not a perfect circle but is defined by alternated small arc portions and large arc portions, for example, a cross section in a laterally long, flattish shape such as an oval and a racing track, or a cross section in a substantially rectangular shape with small arc-shaped corner portions.

A shell main body may have an outer shell without a bead and an inner shell provided with inward beads, acting as a radially projecting bead of the present invention, continuously extending in a circumferential direction along each of right and left small arc portions of a laterally long, flattish cylindrical shell main body so as to form passages inside of the inward beads, wherein the passages are designed for an upper gap and a lower gap between the inner shell and the outer shell in upper and lower large arc portions of the shell main body to communicate with each other. This shell main body can have the same operations and effects as those of the first embodiment.

A shell main body may have an inner shell without a bead and an outer shell provided with inward beads, acting as a radially projecting bead of the present invention, extends continuously in a circumferential direction along each of right and left small arc portions of a cylindrical shell main body so as to space the inner shell and the outer shell and define passages on the both sides of the inward beads, wherein the passages are designed for an upper gap and a lower gap between the inner shell and the outer shell in upper and lower large arc portions of the shell main body to communicate with each other. This shell main body can have the same operations and effects as those of the first embodiment.

A bead or beads may be formed on both of an inner shell and an outer shell.

The entire contents of Japanese Patent Application (Tokugan) No. 2004-146841 filed May 17, 2004 is incorporated herein by reference.

What is claimed is:

1. A shell main body for muffler, wherein the shell main body is made of one rolled flat plate and a joint portion of the plate is welded, the shell main body comprising:

an inner shell formed by a part of the plate to have a cylindrical shape with a cross section that is not a perfect circle but is defined by small arc portions alternating with large arc portions; and an outer shell formed by another part of the plate that continues from a portion of the inner shell to wrap an outer surface of the inner shell and having a cylindrical shape with a cross section that is not a perfect circle but is defined by small arc portions alternating with large arc portions, wherein the small arc portions of the inner shell are in close contact with the small arc portions of the outer shell;

wherein the large arc portions of the inner and outer shells form a gap therebetween having an upper gap and a lower gap at an upper side and a lower side thereof, respectively;

wherein at least one of the inner shell and the outer shell is provided with at least one radially projecting bead that extends continuously in a circumferential direction along the small arc portions of the at least one of the inner and outer shells to define a passage inside of the radially projecting bead so that the passage can allow the upper gap and the lower gap to communicate with each other; and wherein the outer shell is provided on an upper surface side thereof with a communicating path allowing the upper gap and an outside of the outer shell to communicate with each other.

2. The shell main body according to claim 1, wherein the communicating path is formed by a gap that is formed between the inner shell and the outer shell and in places excluding welded portions of the inner shell and the outer shell.

3. The shell main body according to claim 2, wherein the at least one radially projecting bead comprises a plurality of radially projecting beads formed along each of the small arc portions of the at least one of the inner shell and the outer shell, and wherein the plurality of radially projecting beads are arranged in an axial direction of the shell main body at intervals.

4. The shell main body according to claim 1, wherein the at least one radially projecting bead comprises a plurality of radially projecting beads formed along each of the small arc portions of the at least one of the inner shell and the outer shell, and wherein the plurality of radially projecting beads are arranged in an axial direction of the shell main body at intervals.

5. A shell main body for a muffler, wherein the shell main body is made of one rolled flat plate and a joint portion of the plate is welded, the shell main body comprising:

an inner shell formed by a part of the plate to have a cylindrical shape with a cross section that is not a perfect circle but is defined by small arc portions alternating with large arc portions; and an outer shell formed by another part of the plate that continues from a portion of the inner shell to wrap an outer surface of the inner shell and having a cylindrical shape with a cross section that is not a perfect circle but is defined by small arc portions alternating with large arc portions, wherein the small arc portions of the inner shell are in close contact with the small arc portions of the outer shell;

wherein the large arc portions of the inner and outer shells form a gap therebetween having an upper gap and a lower gap at an upper side and a lower side thereof, respectively;

wherein at least one of the inner shell and the outer shell is provided with at least one radially projecting bead that extends continuously in a circumferential direction along the small arc portions of the at least one of the inner and outer shells to space the inner shell and the outer shell from each other and define a passage formed on both sides of the radially projecting bead so that the passage can allow the upper gap and the lower gap to communicate with each other; and wherein the outer shell is provided on an upper surface side thereof with a communicating path allowing the upper gap and an outside of the outer shell to communicate with each other.

6. The shell main body according to claim 5, wherein the communicating path is formed by a gap that is formed between the inner shell and the outer shell and in places excluding welded portions of the inner shell and the outer shell.

7. The shell main body according to claim 6, wherein the at least one radially projecting bead comprises a plurality of radially projecting beads formed along each of the small arc portions of the at least one of the inner shell and the outer shell, and wherein the plurality of radially projecting beads are arranged in an axial direction of the shell main body at intervals.

8. The shell main body according to claim 5, wherein the at least one radially projecting bead comprises a plurality of radially projecting beads formed along each of the small arc portions of the at least one of the inner shell and the outer shell, and wherein the plurality of radially projecting beads are arranged in an axial direction of the shell main body at intervals.

* * * * *